United States Patent [19]

Labudde

[11] 4,381,901

[45] May 3, 1983

[54] ANTI-CAVITATION MARINE PROPELLER

[76] Inventor: Russell G. Labudde, 2048 Canterbury Pl., Wheaton, Ill. 60187

[21] Appl. No.: 269,842

[22] Filed: Jun. 3, 1981

Related U.S. Application Data

[63] Continuation-in-part of Ser. No. 67,287, Aug. 17, 1979, abandoned.

[51] Int. Cl.[3] ..... B63H 1/16; B63H 5/08

[52] U.S. Cl. ..... 416/121; 416/133; 416/189

[58] Field of Search ..... 416/121 R, 133, 149, 416/150, 189 R, 124

[56] References Cited

U.S. PATENT DOCUMENTS

| | | | |
|---|---|---|---|
| 1,612,696 | 12/1926 | Béres | 416/124 |
| 1,688,808 | 10/1928 | Gill | 416/150 |
| 1,788,307 | 1/1931 | Lack | 416/121 |
| 2,133,853 | 10/1938 | Feige | 416/133 X |
| 2,192,469 | 3/1940 | Green | 416/121 |
| 3,023,813 | 3/1962 | Fengler | 416/124 |
| 3,209,156 | 9/1965 | Struble | 416/189 A X |
| 3,549,271 | 12/1970 | Kuboya | 416/124 |
| 3,806,278 | 4/1974 | Grennan | 416/133 X |

FOREIGN PATENT DOCUMENTS

| | | | |
|---|---|---|---|
| 881454 | 6/1953 | Fed. Rep. of Germany | 416/189 R |
| 1503647 | 3/1969 | Fed. Rep. of Germany | 416/121 |
| 1002263 | 3/1952 | France | 416/121 |
| 52-13046 | 2/1977 | Japan | 416/121 |
| 1324356 | 7/1973 | United Kingdom | 416/189 R |
| 1325395 | 8/1973 | United Kingdom | 416/189 R |

*Primary Examiner*—Everette A. Powell, Jr.

[57] ABSTRACT

A marine propeller system comprising three individual elements, two of which are propellers mounted on a common shaft driven by a prime mover and the third being a cylindrical tube surrounding and movable relative to the two propellers, the tube having its interior surface in the form of a pair of equal and opposing truncated cones meeting midway of the ends of the tube. The rearward propeller is conventionally keyed to the driven shaft and fast thereon and the forward propeller is axially movable on the shaft and is arranged to be driven by the rearward propeller whereby, depending upon hydraulic pressures within the cylinder, the forward or driven propeller is shiftable relative to the rearward or driving propeller to maintain a spiral discharge from the cylinder with annular wake influence lines and substantially free of cavitation regardless of vessel load or speed.

9 Claims, 8 Drawing Figures

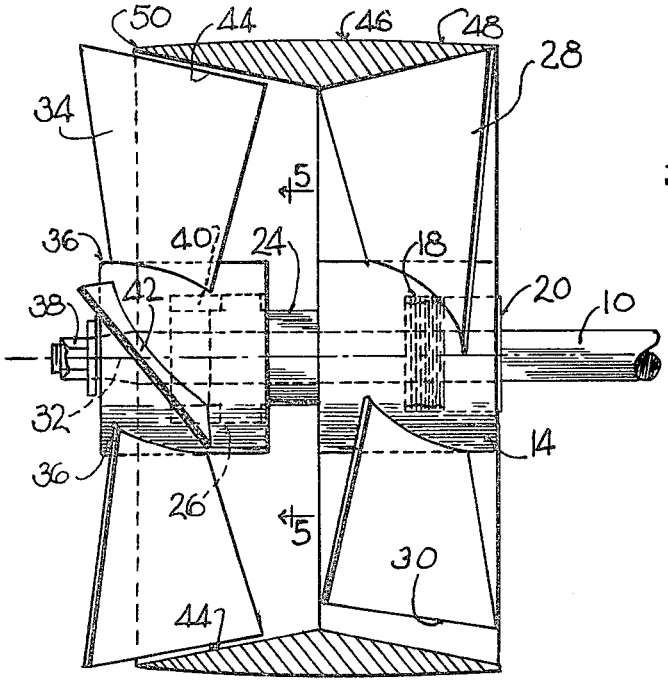
FIG-7
FIG-8
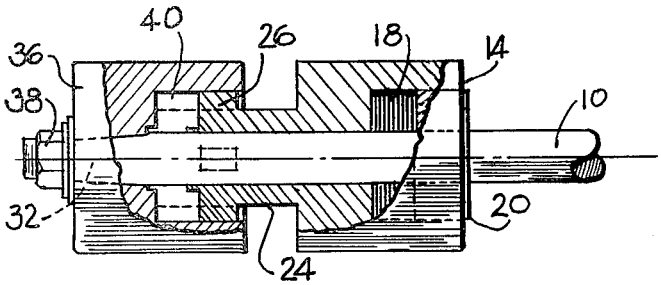

ANTI-CAVITATION MARINE PROPELLER

This application is being filed as a continuation-in-part of applicant's copending application Ser. No. 67,287 filed Aug. 17, 1979, now abandoned, for ANTI-CAVITATION MARINE PROPELLER.

BACKGROUND OF THE INVENTION

In conventional marine propellers, cavitation occurs at the leading edge of the tip of the blade during high torque, high rpm and heavy load operation because high blade element angle of attack leads to separation of the boundary layer around the tip of the blade, which depresses local static pressures below that vaporizing water at ambient temperature, thereby creating vapor bubbles which collapse with destructive force to cause disturbance in the flow about the whole blade causing low propulsive efficiency and a very turbulent and energy absorbing wake. In the past, much has been done in the field of propeller design, particularly with respect to marine propellers, and in that field various forms and arrangements of ring propellers and shrouded propellers have been devised with the object of improving operational efficiency. In the case of shrouded propellers, the encircling structure is usually fixed or stationary, and in the case of ring propellers, the surrounding ring is fast on the propeller blade tips. None of these schemes has been particularly successful, however, and the present invention resulted from work directed to increasing propulsion efficiency through improved control of the fluid flow through the propeller system.

SUMMARY OF THE INVENTION

The gist of this invention resides in the combination with a pair of axially adjustable propellers mounted on a common shaft in driving relation with each other of a separate and independently movable, flow accelerating cylinder surrounding the propellers and having an interior surface in the form of a pair of opposed truncated cones meeting substantially midway between the ends of the cylinder whereby to utilize the principle that when a fluid in a tube passes through a reduced cross-sectional area, an increase in velocity and a corresponding decrease in pressure will occur, and to employ that principle in a hydraulic medium for absolute fluid flow control to produce uniform thrust, the combination being one which will automatically adjust to increase or decrease of load. In this system, the forward or charging propeller, while driven by the rearward or discharging propeller, is axially shiftable on the power shaft, automatically, in direct relation with the pressures developed by the charging propeller within the inlet cone of the accelerating cylinder.

DESCRIPTION OF THE DRAWINGS

FIG. 7 is a view similar to FIGS. 1 and 2 but showing the system as it would appear when operating in reverse; and FIG. 8 is a partially sectioned view showing the axially shiftable driving connection between the propeller hubs as they would appear without the propellers.

DESCRIPTION OF A PREFERRED EMBODIMENT

Figure 1:
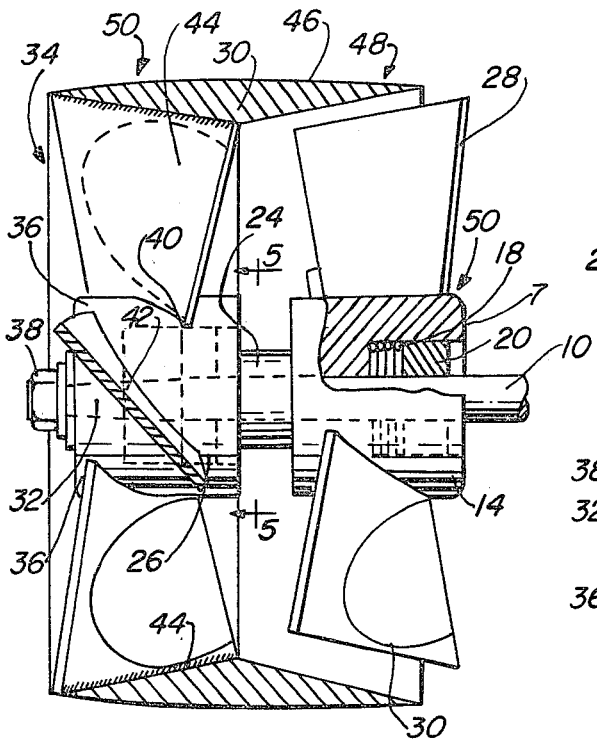
FIG. 1 is a fragmentary cross-sectional side view of the improved propeller system as it would appear during high thrust and high speed operation.
Figure 2:
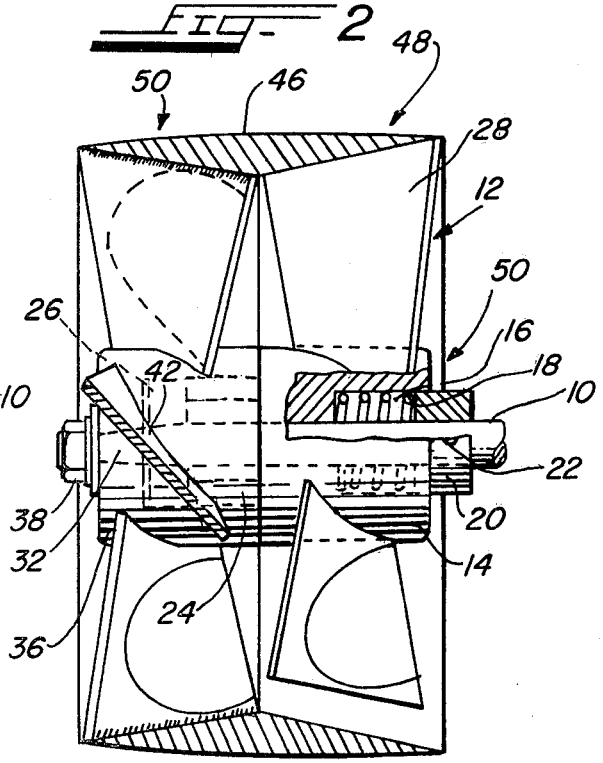
FIG. 2 is a fragmentary cross-sectional side view of the same as it would appear during high torque and low speed operation.

FIGS. 1 and 2 show my improved anti-cavitation propeller assembly mounted on a shaft 10 which is operationally connected to a prime mover (not shown). A charging propeller 12 having a hub 14 is slidably mounted on a forward portion of the shaft 10 which extends to the right for connection to the prime mover. A cylindrical counterbore 16 in the front face of the hub 14 and concentric with the shaft 10 contains a compression spring 18 restrained therein by a collar 20 which is suitably secured to the shaft 10, as by a setscrew 22, and which is sized to slidably operate in the counterbore 16. As shown in FIGS. 1, 7 and 8, the hub 14 is made with a concentric extension 24 projecting from the rear face of the hub and having a diameter of about one-half that of the hub, the extension 24 having the same bore as the hub for slidably receiving the shaft 10. Also as shown, particularly in FIGS. 5 and 8, the extension 24 is made with a plurality of splines 26 equi-angularly spaced about the rearward end of the extension and having a purpose to be later explained.

Figure 3:
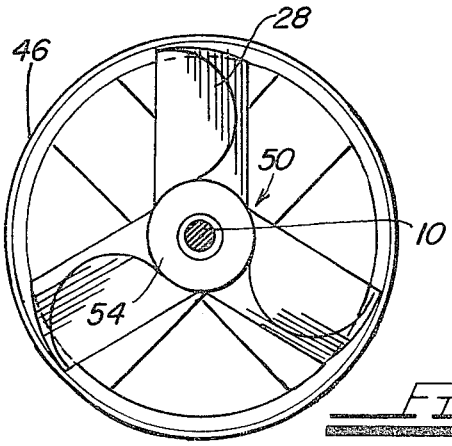
FIG. 3 is a front view of the propeller combination as seen from the right hand side of FIGS. 1 and 2.

As shown in FIGS. 1, 2 and 3, the propeller 12 comprises three angularly spaced blades 28 which radiate from the hub 14 and which have conically tapered tip ends 30 which converge in the aft direction from the forward plane of the propeller 12 to the rearward plane thereof at an angle of about 12° from a line parallel with the axis of the shaft 10.

As shown, a discharge propeller 34 having a hub 36 is mounted on the aft end of the shaft 10 which is provided with a male taper 32 adapted to be received within a female tapered bore formed in the hub 36, which bore engages and keys to the tapered end of the shaft 10 in the conventional manner of marine propeller and shaft mountings. Also, the aft end of the shaft 10 is threaded to receive a hub nut 38 and suitable washers to secure the hub 36 onto the shaft.

Figure 6:
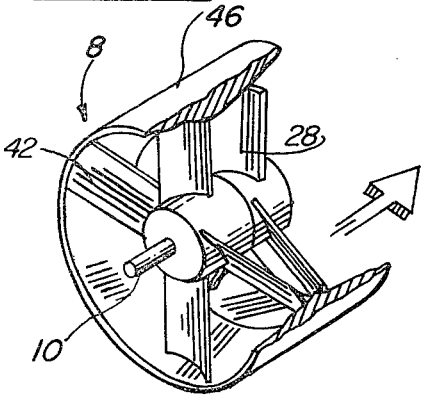
FIG. 6 is a cutaway perspective view of the propeller combination.
Figure 5:
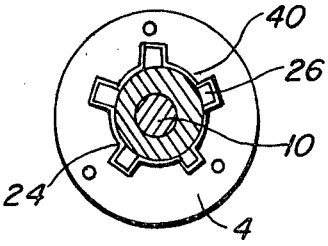
FIG. 5 is a sectional view as taken along the line 5—5 of either FIG. 1 or FIG. 7.

As indicated in FIG. 5 and as shown in FIG. 8, the hub 36 is provided with a female splined counterbore 40 in its front face in concentric relation with the shaft 10 for slidably receiving and engaging the extension 24 of the hub 14 and the male splines 26 thereon, the depth of the counterbore 40 being equal to the length of the extension 24 of the hub 14 whereby the hubs 14 and 36 can abut each other endwise, as shown in FIGS. 2 and 6.

Figure 4:
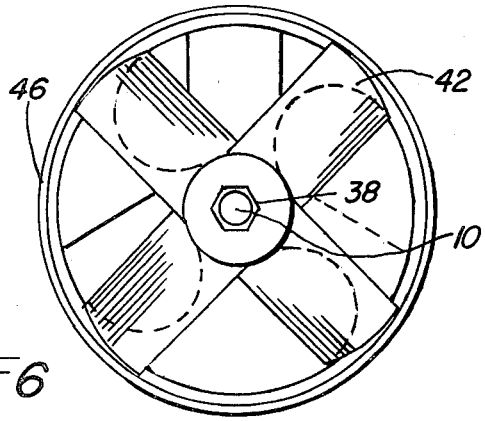
FIG. 4 is a rear view of the same as seen from the left hand side of FIGS. 1 and 2.

In the form shown, the discharge propeller 34 comprises four equal angularly-spaced blades 42 which radiate from the hub 36, as shown in FIGS. 4 and 6, each of the blades having a conically tapered tip end 44 which converges in the forward direction from the rearward plane of the propeller 34 toward the forward plane thereof at the same angle relative to the axis of the shaft 10 as the taper of the tip ends of the blades 28 of the charging propeller 12.

As shown, an independent cylindrical tube 46 surrounds thw two propellers and has fore and aft portions 48 and 50, the inner surfaces of which are in the form of truncated cones converging inwardly in opposing relation to a point midway between the ends of the tube, the taper of these converging surfaces being exactly the same as the taper of the tips 30 and 44 of the propeller blades 28 and 42, respectively. As shown, the length of this cylindrical tube is the same as the distance between the forward plane of the propeller 12 and the rearward plane of the propeller 34 when the propeller hubs 14 and 36 are in end-to-end abutment, as shown in FIG. 2.

Since the hub 36 of the discharge propeller 34 is fixed to the prime mover shaft 10 and the hub 14 of the charging propeller 12 is held into compression position with the hub 36 by the action of spring 18 and retainer 20, it will now be apparent that annular support of the cylinder 46 is dependent on the traction engagement of the tip ends 30 and 44, of the propeller blades 28 and 42, with the respective inlet and outlet cone surfaces of the cylinder 46.

In the inlet cone surrounding the charging propeller 28, the velocity of the fluid is dependent on the approach velocity of the vessel plus the velocity increase from the propeller 28 thereby increasing the pressure within the inlet cone. This increased pressure will force the cylinder 46 and the outlet cone thereof against the tip ends of the discharge propeller blades 42. This is a normal slow speed condition of the mechanism. To produce uniform turbulence under a high speed mode of operation, the charging propeller 28 will advance axially forward because of its inherent thrust and the increased fluid pressure acting equally on the wall surfaces of the inlet cone and on the blade surfaces of the charging propeller. This axial advance of the charging propeller 28 is limited in travel by the spring retainer 20 and occurs whenever the propeller system is under a high speed mode of operation. At this point, it will be noted that the charging propeller 12 does not advance axially to separate from the propeller 42 but rather to advance axially from the reduced cross-sectional area at the midpoint of the surrounding accelerating cylinder 46.

The attitude of the propeller assembly when the device is at rest and/or at a very slow speed is as shown in FIG. 2 and is caused by the reaction of the spring 18 and the retainer 20, the retainer 20 being fixed to the shaft 10.

Upon application of power, the entire assembly rotates as a unit, since the two sets of propeller blades exert traction stresses against the internal conical wall surfaces causing the cylinder to also rotate at a uniform rate. As the prime mover increases in speed, however, the water passing through the cylinder 46 is many times that which is passing under the vessel hull and at the same time, the velocity of the inlet cone water is increasing, along with increased pressure in the front cone resulting from the increased velocity of the water as it passes through the reduced cross-sectional area of the front cone. This pressure within the front cone will be equal on all surfaces, including the charging propeller blades, and will lift or move the charging propeller hub forward axially, against the spring 18 and "stop" collar 20. During this movement, the acceleration cylinder 46 is forced toward and is completely supported by the four blades of the discharge propeller, as shown in FIG. 1. This results from pressure build-up in the front cone.

When the water enters the reduced area of the cones, it will accelerate greatly and also lower in pressure at the same rate. The water flow has now increased in speed and is kept in a uniform convolute state in the rear cone while the discharge propeller blades virtually sweep the rear cone walls of this convolute water. Because of this sweeping action, the discharged water will not collapse and cause cavitation, but rather the wake water should remain in a spiral or convolute state of motion which should also persist because the pressure of the water discharged is less than the ambient pressures of the surrounding hydraulic medium.

When the propeller system is operating in a reverse mode, the same action as stated above will occur, except the cylinder 46 will axially move in the forward direction against the three blades of the front propeller which will compress the spring 18. In this mode of operation, the rear propeller is fixed in respect to the prime mover shaft. However, the cylinder 46 is free to move axially with respect to the shaft 10.

Although but one specific embodiment of this invention has been herein shown and described, it will be understood that details of the construction shown may be altered or omitted without departing from the spirit of this invention as defined by the following claims.

I claim:

1. A marine propeller system comprising:

(a) a charging propeller and a discharge propeller mounted end-to-end on a common shaft, (b) said discharge propeller having a hub secured fast on said shaft and said charging propeller having a hub axially slidable on said shaft, (c) said charging propeller having driving connection with said discharge propeller, (d) means for limiting axial movement of said charging propeller, and (e) a cylindrical tube surrounding said propeller and having an inside surface comprising a pair of truncated cones converging inwardly of the tube in opposed relation and meeting between the ends of the tube to provide a passage therein of less diameter than the ends of said tube, (f) said tube being mechanically free of said propeller and removable axially relative thereto.

2. A device as defined by claim 1 in which the means limiting axial movement of the charging propeller includes means for normally urging the said propeller toward the discharge propeller.

3. A device according to claim 1 in which the driving connection between said propellers comprises a concentric rearward extension on the charging propeller hub slidably received in a concentric bore in the adjacent end of the discharge propeller hub and spline means providing driving connection between said extension and said bore.

4. A propeller device as defined by claim 2 in which the charging propeller hub has a counterbore in its forward end, a collar mounted fast on said shaft adjacent the opening of said counterbore, and a coiled compression spring disposed in said counterbore between the bottom thereof and said collar normally urging the charging propeller toward said discharge propeller.

5. A propeller assembly as defined by claim 1 in which the truncated inwardly-converging cones of said tube meet in opposed relation midway between the ends of the tube.

6. A propeller assembly as defined by claim 1 wherein the tip ends of the charging propeller blades are inclined rearwardly from the front plane of the charging propeller and the tip ends of the discharge propeller blades are inclined forwardly from the rear plane of the discharge propeller, in each case as though following a converging conical surface.

7. A propeller assembly as defined by claim 6 wherein the ends of the propeller blades are parallel with the respective surrounding conical surfaces of the said tube.

8. A propeller assembly as defined by claim 7 wherein each propeller has the same diameter from end-to-end as the diameter of the surrounding conical surfaces of the tube when the planes of the mutually facing ends are coincident with the meeting line of the inwardly converging cones of the tube.

9. A propeller assembly as defined by claim 8 wherein the width of each propeller is the same as the length of the respective surrounding conical surface of the tube.

* * * * *